US008312871B1

(12) United States Patent
Kulp et al.

(10) Patent No.: US 8,312,871 B1
(45) Date of Patent: Nov. 20, 2012

(54) INDUCTION DRIVE MECHANISM FOR A PAINTBALL LOADER

(76) Inventors: Donald Lee Kulp, Lititz, PA (US); Robert E. Long, Jr., Willow Street, PA (US); Michael J. Fiorill, Lancaster, PA (US)

( * ) Notice: Subject to any disclaimer, the term of this patent is extended or adjusted under 35 U.S.C. 154(b) by 956 days.

(21) Appl. No.: 12/351,386

(22) Filed: Jan. 9, 2009

Related U.S. Application Data

(60) Provisional application No. 61/020,563, filed on Jan. 11, 2008.

(51) Int. Cl.
*F41B 11/02* (2006.01)

(52) U.S. Cl. .... 124/51.1; 124/82; 310/103; 310/154.02; 310/181; 310/189; 310/191; 366/219; 366/241; 366/273; 366/274; 366/279

(58) Field of Classification Search ..... 124/51.1, 124/82; 310/103, 154.02, 181, 189, 191; 366/219, 241, 273, 274, 279
See application file for complete search history.

(56) References Cited

U.S. PATENT DOCUMENTS 4,199,265 A * 4/1980 Sanderson et al. ..... 366/274
4,568,195 A * 2/1986 Herz et al. ..... 366/274
4,892,863 A * 1/1990 Agarwala ..... 505/166
5,141,327 A * 8/1992 Shiobara ..... 366/274
5,440,185 A * 8/1995 Allwine, Jr. ..... 310/156.37
5,791,325 A * 8/1998 Anderson ..... 124/56
5,816,232 A * 10/1998 Bell ..... 124/51.1
5,947,100 A * 9/1999 Anderson ..... 124/45
6,109,252 A 8/2000 Stevens
6,206,562 B1 * 3/2001 Eyraud et al. ..... 366/273
6,213,110 B1 * 4/2001 Christopher et al. ..... 124/51.1
6,305,367 B1 10/2001 Kotsiopoulos et al.
6,347,621 B1 2/2002 Guthrie
6,418,919 B1 * 7/2002 Perrone ..... 124/49
6,467,473 B1 10/2002 Kostiopoulos
6,488,019 B2 12/2002 Kotsiopoulos
6,502,567 B1 * 1/2003 Christopher et al. ..... 124/51.1
6,644,293 B2 * 11/2003 Jong ..... 124/52
6,701,907 B2 * 3/2004 Christopher et al. ..... 124/48
6,739,323 B2 * 5/2004 Tippmann, Jr. ..... 124/51.1
6,792,933 B2 * 9/2004 Christopher et al. ..... 124/56
7,168,848 B2 * 1/2007 Gigas et al. ..... 366/270
7,357,567 B2 * 4/2008 Terentiev ..... 366/273
7,445,002 B2 * 11/2008 Christopher et al. ..... 124/51.1
7,481,572 B2 * 1/2009 Terentiev ..... 366/279
7,607,424 B2 * 10/2009 Monks ..... 124/77
7,762,716 B2 * 7/2010 Terentiev et al. ..... 366/273
7,832,389 B2 * 11/2010 Christopher ..... 124/51.1
(Continued)

*Primary Examiner* — Gene Kim
*Assistant Examiner* — Alexander Niconovich
(74) *Attorney, Agent, or Firm* — Andrew D. Mead

(57) ABSTRACT

An electronically controlled, brushless DC, electromagnetic induction drive apparatus for use in a paintball marker active loader capable of directly driving the feeder element in the active loader while providing user selectable torque transfer capability and rotational speed whether used to continuously or intermittently rotate the loader feeder element. A plurality of selectively polarity reversible electromagnets are disposed in the loader housing and act to move a plurality of magnetic drive elements disposed on the rotating feed cone to rotate the feed cone and cause paintballs to be fed into the paintball marker via a feed tube. A controller linked to the marker firing sequence manages the sequential polarity changes of the electro-magnets to cause the feed cone to rotate in response to movement of paintballs in the feed tube. The spatial relationship between the drive electromagnets and the driven magnetic elements is user adjustable to enable variation in the torque transfer of the drive apparatus to suit specific paintball characteristics.

14 Claims, 4 Drawing Sheets

U.S. PATENT DOCUMENTS

| | | | | |
|---|---|---|---|---|
| 7,841,328 | B2 * | 11/2010 | Italia et al. | 124/51.1 |
| 7,921,835 | B2 * | 4/2011 | Campo et al. | 124/51.1 |
| 7,948,141 | B2 * | 5/2011 | Takeuchi | 310/191 |
| 7,966,999 | B2 * | 6/2011 | Bosch et al. | 124/51.1 |
| 8,047,191 | B2 * | 11/2011 | Christopher et al. | 124/51.1 |
| 2006/0267436 | A1 * | 11/2006 | Naito et al. | 310/156.32 |
| 2007/0029889 | A1 * | 2/2007 | Dunn et al. | 310/156.43 |
| 2007/0062506 | A1 * | 3/2007 | Bell | 124/51.1 |
| 2007/0137631 | A1 * | 6/2007 | Christopher | 124/49 |
| 2009/0133680 | A1 * | 5/2009 | Christopher et al. | 124/51.1 |
| 2009/0241929 | A1 * | 10/2009 | Italia et al. | 124/51.1 |
| 2010/0206282 | A1 * | 8/2010 | Italia et al. | 124/51.1 |
| 2010/0258101 | A1 * | 10/2010 | Campo et al. | 124/51.1 |
| 2011/0067681 | A1 * | 3/2011 | Stevens et al. | 124/51.1 |
| 2011/0186025 | A1 * | 8/2011 | Campo et al. | 124/51.1 |

* cited by examiner

INDUCTION DRIVE MECHANISM FOR A PAINTBALL LOADER

CROSS-REFERENCE TO RELATED APPLICATIONS

This application claims the benefit of priority of U.S. Provisional Application 61/020,563, filed Jan. 11, 2008.

BACKGROUND OF THE INVENTION

This invention relates generally to a paintball loaders and, more specifically to an electro-magnetic induction drive mechanism for rotating a feed cone in an active feed paintball loader.

The sport of paintball war games continues to grow in popularity. During these war games, participants shoot frangible plastic balls full of a liquid dye at their opponents. The games are sometimes intensely competitive, requiring a participant to aim a gun, known also as a marker, at an opponent while pursuing, fleeing, dodging, or running for cover. Participants are excluded from further play once they have been hit and marked by a paintball. Success in the game requires the capability to fire a large number of paintballs in a short amount of time. A participant might discharge between several hundred and one thousand or more paintballs during the typical game lasting only a few minutes. Success in the game also requires player agility, which include being able to move run, dive, and roll for cover while carrying the marker.

Agitating paintball loaders are well known in the art of paintball sports, and operate by having a paintball agitator advance balls from the bottom of a loader into an outfeed tube. Active or force feeding paintball loaders are technologically advanced loaders that use powered drivers to forcibly drive paintballs from the loader, into an outfeed tube, and into the breech of a paintball marker. Examples of such loaders can be found in U.S. Pat. Nos. 6,213,110, 6,502,567, 6,701,907, and 6,792,933. As paintball loaders have evolved into electronically controlled devices capable of actively or forcibly feeding increasingly greater numbers of paintballs into a paintball gun, the demands upon the feed apparatus in such loaders has increased accordingly. One problem now arising in such active paintball loaders occurs when multiple paintballs approach the outfeed tube simultaneously. The loader drive mechanism must either temporarily suspend actuation of the feeding apparatus or risk rupturing the paintballs in the loader, the latter condition rending the paintball loader, and indeed the entire marker, effectively inoperable. These technologies are subject to breaking, wearing, or require cumbersome fixed magnet adjustments.

One method for intermittently actuating the feeding mechanism is to incorporate a torsion spring into the drive apparatus for the paintball feeding mechanism and control operation of a motor drive such that it is intermittently operated in response to firing of the paintball marker. Rotation of the drive motor winds the spring which, in turn, causes the feeding mechanism to rotate when possible, such as when a paintball moves from the feeding tube into the marker's firing chamber. Such devices require complex controls to sense marker firing and manage operation of the drive motor. Additionally, once the spring is fully wound, engagement of the drive motor may cause a jammed paintball to rupture unless the torque output of the drive motor is somehow limited.

Another method is to interpose a friction clutch between the drive motor and the feeding mechanism to limit the torque transfer to the feeding mechanism. The problem with friction devices is that torque transfer capability tends to vary as the friction surface wear. While this method might prevent unintentional paintball rupture since torque transfer is at a maximum when new friction surfaces are used and decline from that time on, the torque transfer capability will eventually become insufficient to urge paintballs from the loader to the marker as the friction materials wear. The wear time may be extended thorough use of an intermittently rotating drive motor, but such an approach requires the complicated motor controls similar to those used in the spring-based feeding mechanisms.

The above solutions are subject to breaking, wearing, or require cumbersome fixed magnet adjustments. All existing loader technologies use a traditional, brush-commutated, DC motor. This motor accepts a DC voltage causing electromagnets (much like the brushless DC design) to interact with permanent magnets. Unlike the brushless DC design, as this interaction takes place through motor rotation, components called brushes make and break connections to cause the polarity of the electromagnets to continuously cycle between positive and negative. This changing of polarity constantly pushes and pulls on the permanent magnets causing the motor to spin. Power is lost in the brushes, heat is generated from the lost power, the motor must spin at high speeds, and be reduced mechanically to produce the desired torque, and the torque is difficult to control, necessitating the mechanical components of ratio reduction and mechanical clutches.

It would therefore, be a great advantage to provide a drive apparatus for use in a paintball marker drive mechanism based on a brushless DC design capable of providing easily manageable torque transfer capability whether used with to continuously or intermittently operate the feeder mechanism. Still further advantages would be realized if the torque transfer capability of the apparatus could be selectively altered by a user to suit specific conditions. By controlling the torque transferred through the drive mechanism, inadvertent paintball rupture can be reduced if not eliminated.

SUMMARY OF THE INVENTION

Accordingly, it is an object of the present invention to provide a drive apparatus for use in a high feed rate paintball loader incorporating a brushless DC motor design in which the polarity of a plurality of electromagnets drivers is managed by an electronic circuit such that interaction of the selective polarity stationary drive electromagnets with a plurality of ferretic driven elements disposed on a rotating paintball feeder element, by proper sequencing of the polarity of the drive magnets, allows the feeder element to be selectively rotated.

It is a further object of the present invention to provide an improved torque-limited drive apparatus for an active paintball loader that allows the loader to supply paintballs to the marker at least as rapidly as the marker's firing rate. Many modern paintball markers are capable of firing up to 25 paintballs per second.

It is a further object of the present invention to provide a magnetic induction based drive apparatus for use in an active paintball loader that limits the amount of torque transferred into the feeder element to an amount less than the that causing of rupture of the paintballs in the loader apparatus. A paintball rupture in the loader apparatus effectively jams the marker, generally resulting in inoperability of the loader/marker combination.

It is a further object of the present invention to provide a magnetic induction based drive apparatus for use in an active paintball loader that allows a user to selectively alter the amount of torque transferred into the feeder element thereby enabling the loader apparatus to be optimized for variations in paintball rupture strength.

It is a further object of the present invention to provide a torque-limiting drive apparatus for an active paintball loader that offers offering highly reliable performance. Many paintball games continue for only a few minutes during which time participants discharge thousands of paintballs. A participant with a non-functional marker is quickly "marked" and eliminated from the competition.

It is a further object of the present invention to provide magnetic induction based drive apparatus for the feed cone in a paintball loader that directly drives the feeder element and eliminates the need for a reducing gear train between the driver and the feeder element.

It is a still further object of the present invention to provide a magnetic induction-based drive apparatus for advancing the feeder element in an active paintball loader that is compatible with a variety of known active loader designs and therefore easily retrofit as an improvement to existing paintball loader designs.

It is a still further object of the present invention to provide an electronically controlled magnetic induction based drive apparatus for advancing the feeder element that monitor the torque applied to the feeder element and initiates advancement of the feeder element based on variations in that torque.

It is a still further object of the present invention to provide a torque-limiting drive coupling for the feeder mechanism in an active paintball loader that is durable in construction, inexpensive of manufacture, carefree of maintenance, easily assembled, and simple and effective to use.

These and other objects are achieved by the instant invention by providing an electronically controlled, brushless DC, electromagnetic induction drive apparatus for use in a paintball marker active loader capable of directly driving the feeder element in the active loader while providing user selectable torque transfer capability and rotational speed whether used to continuously or intermittently rotate the loader feeder element. A plurality of selectively polarity reversible electromagnets are disposed in the loader housing and act to move a plurality of magnetic drive elements disposed on the rotating feed cone to rotate the feed cone and cause paintballs to be fed into the paintball marker via a feed tube. A controller linked to the marker firing sequence manages the sequential polarity changes of the electro-magnets to cause the feed cone to rotate in response to movement of paintballs in the feed tube. The spatial relationship between the drive electromagnets and the driven magnetic elements is user adjustable to enable variation in the torque transfer of the drive apparatus to suit specific paintball characteristics.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Various components shown or described herein for any specific application of this invention can be varied or altered as anticipated by this invention and the practice of a specific application of any element may already by widely known or used in the art by persons skilled in the art and each will likewise not therefore be discussed in significant detail. When referring to the figures, like parts are numbered the same in all of the figures.

Figure 1:
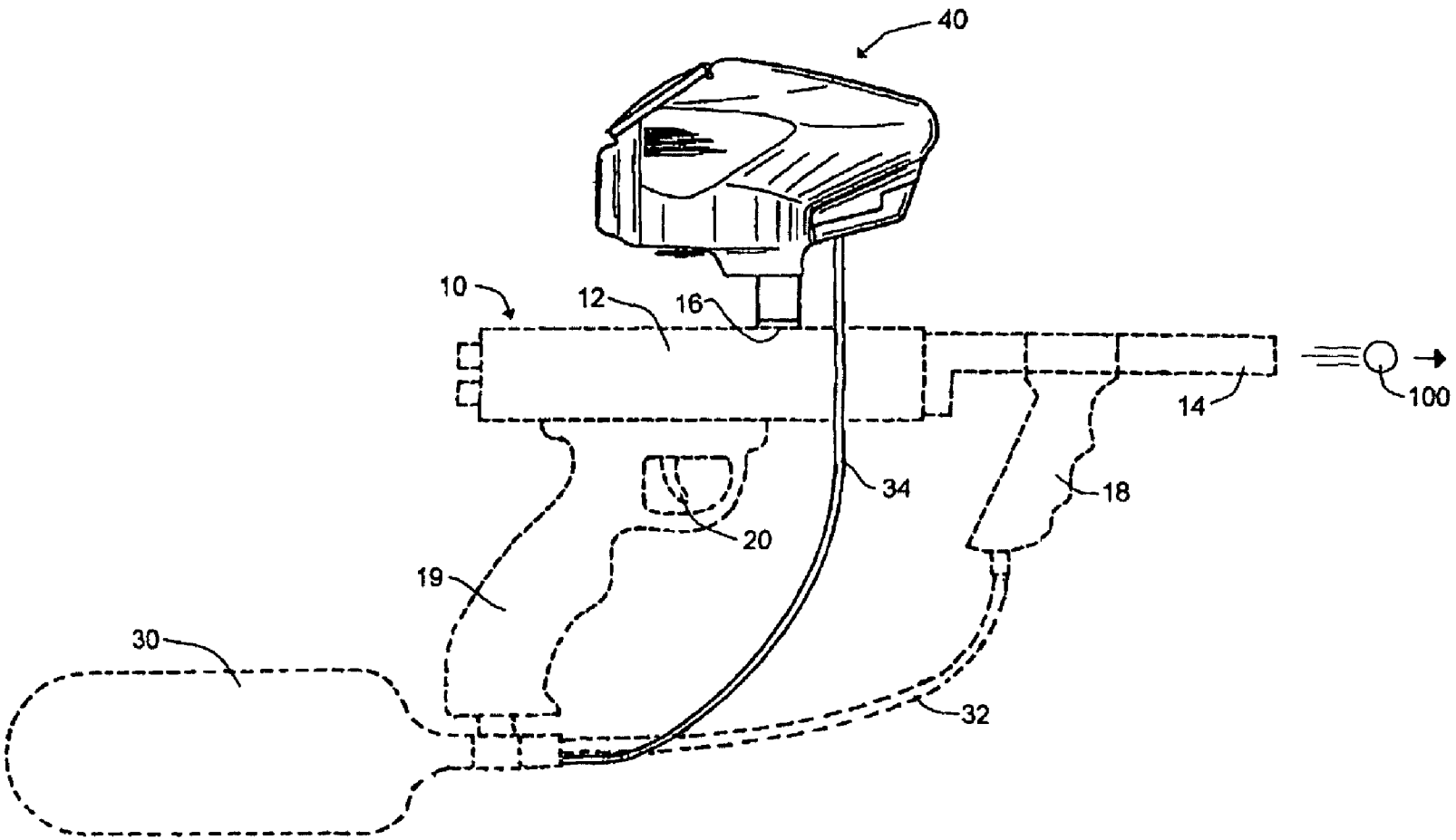
FIG. 1 shows a side view of a typical paintball marker and active loader of the type on which the present invention proves useful.

FIG. 1 shows a side elevation view of a typical paintball marker 10, illustrated in phantom, having an attached active feed loader 40 of the type in which the present invention is useful. Paintball marker 10 is a pneumatically-operated gun for discharging paintballs and is well-known in the art. Paintball marker 10 includes a main body 12, a barrel 14, a compressed gas supply cylinder 30, a front handgrip 18, and a rear handgrip 19. The front handgrip 18 projects downwardly from the barrel 14 and, along with rear handgrip 19, provide areas for gripping by an operator of the paintball marker 10. Paintball marker 10 also includes an inlet opening 16 leading to a firing chamber (not shown) in the interior of the main body 12 and a trigger 20. The firing chamber also opens to barrel 14 through which projectiles, paintballs 100 in the preferred embodiment, are propelled. The compressed gas cylinder 30 is typically secured to a rear portion of the paintball marker 10. Compressed gas is supplied to the marker via a pressure regulator (not shown) by gas supply line 32. Loader feed line 34 may be used to provide compressed gas to loader 40 containing the present invention. Alternatively, loader feed line 34 may be connected to compressed gas control line within marker 10, thereby taking advantage of the pneumatic sequencing controls occurring with the marker. The compressed gas cylinder 30 normally contains CO2, although any compressible gas may be used.

Operation of marker 10 is selectively controlled by trigger 20 which directs the admission of compressed gas, supplied by storage cylinder 30 via gas supply line 32, to a marker firing control apparatus (not shown) for a firing mechanism. The marker firing control apparatus coordinates pressurized gas supply to mechanisms with the marker to fire, reload, and prepare the marker to fire again. The bursts of gas are used to eject paintballs outwardly through the barrel 14 by operation of a firing mechanism. After firing, compressed gas is used to reposition a bolt in the firing chamber to open inlet opening 16 thereby allowing another projectile to be loaded into the firing chamber from the loader 40. Compressed gas is then used to re-position the bolt so that the marker is ready to fire the projectile in response to a pull of the trigger 20. The paintballs are continually fed by the paintball loader 40 through the inlet tube 16 to the firing chamber. Although FIG. 1 depicts an automatic paintball marker 10, the paintball marker 10 may also be a semi-automatic marker.

Figure 2:
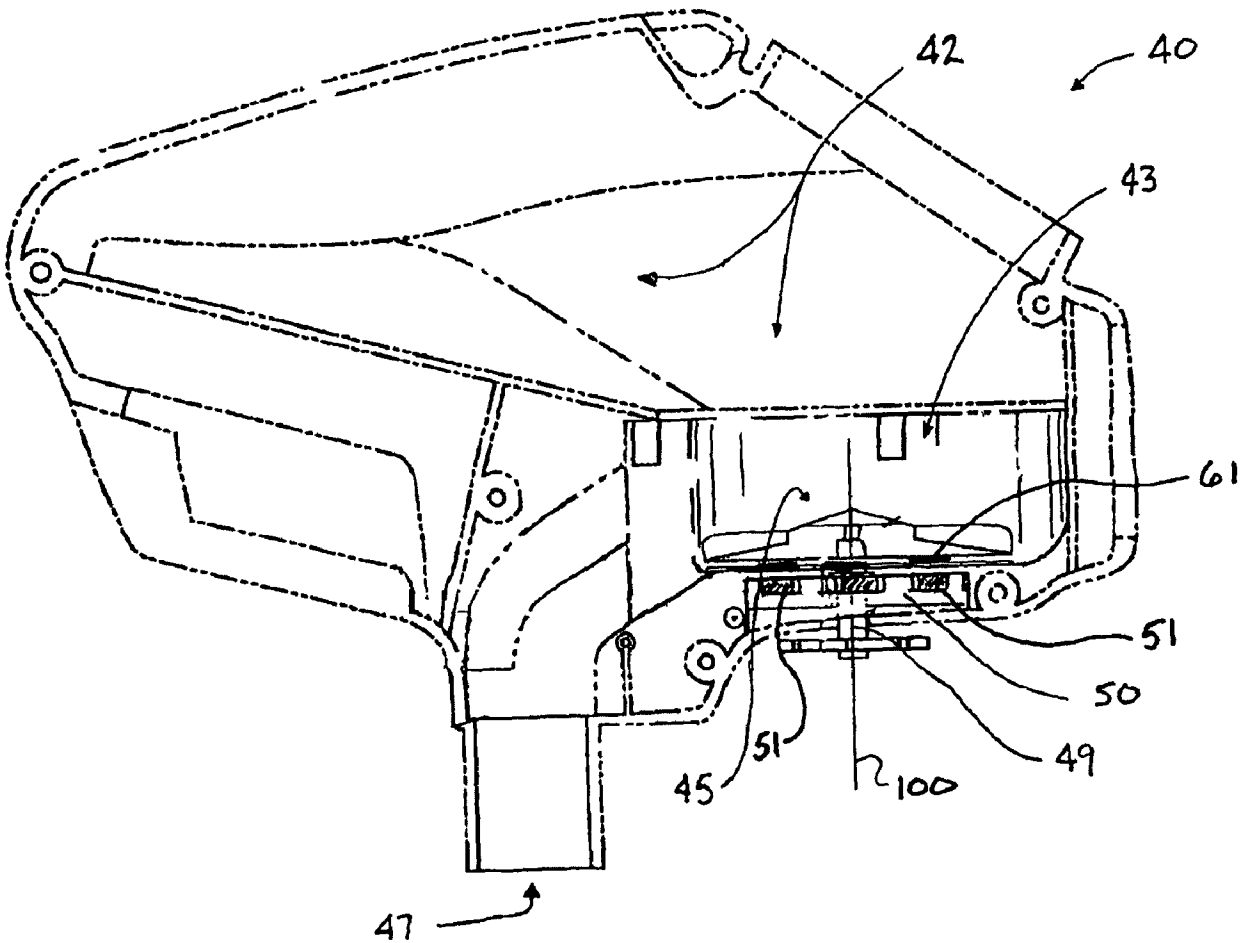
FIG. 2 shows a partial side view of a paintball loader and the location of one embodiment of the magnetic induction drive of the present invention.

Now referring to FIG. 2 wherein a side elevation view of the active feed loader 40 is presented comprising a paintball container (or hopper) 42 with a rotatable feed cone 45 disposed in the lower portion 43 of the hopper, and an outfeed tube 47 for supplying paintballs from the loader 40 to the marker inlet opening. Feed cone 45 is rotatably mounted on a shaft 49 aligned along a rotational axis 100. Rotation of the feed cone 45 may be accomplished by fixing the cone for rotation with the shaft or by configuring the shaft to serve as an axle to constrain the rotational motion of the cone. Active feed paintball loaders are well-known in the art and described in detail in U.S. Pat. No. 6,213,110, "Rapid Feed Paintball Loader," and U.S. Pat. No. 6,502,567, "Rapid Feed Paintball Loader With Pivotable Deflector," the entire contents of which are each incorporated herein by reference.

The present drive apparatus also comprises a drive platform 50 which is connected to the loader 40. A plurality of electromagnetic drive members 51 are connected to platform 50 and arranged in a generally circular arrangement about rotational axis 100. Drive members 51 remain fixed with respect to the drive platform 50 which also fixed their angular position about axis 100. Drive platform 50 may be moved in either direction along rotational axis 100 to allow separation between the platform 50 and the lower side of feeder cone 45 to be selectively altered.

Figure 3:
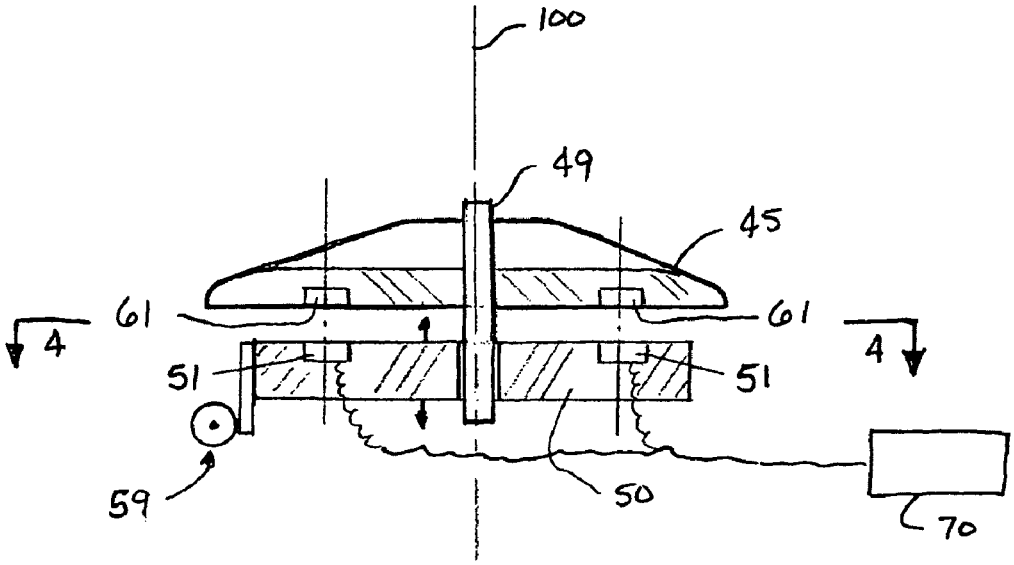
FIG. 3 shows a section view of the stationary magnetic drive elements disposed in the loader housing and the magnetic driven elements disposed in the rotating feed cone of the loader.
Figure 4:
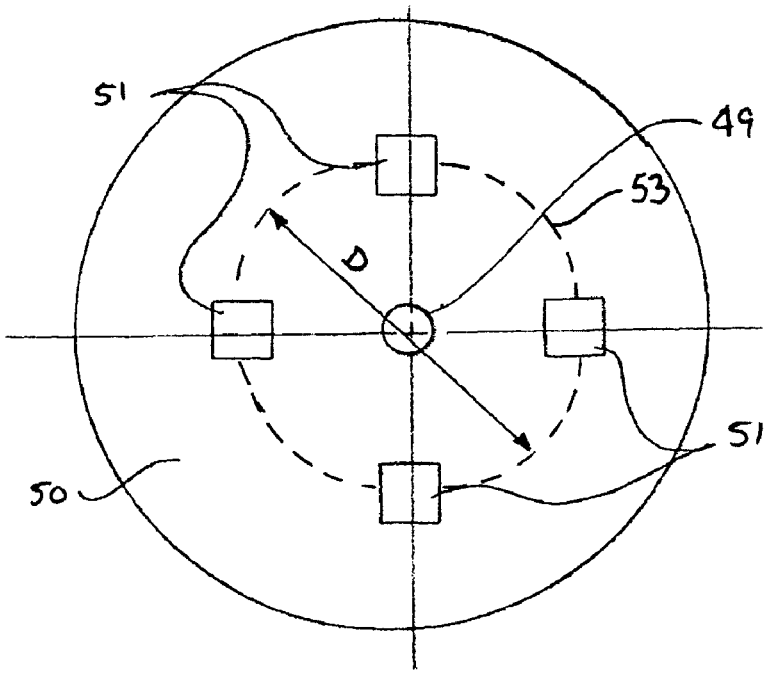
FIG. 4 is a section view taken along section 4-4 in FIG. 3 showing the arrangement of the drive and driven elements around the rotational axis.

FIGS. 3 and 4 provide a detailed view of the drive apparatus illustrating the relationship between the drive platform 50 and the feed cone 45. The present invention design employs a brushless DC (BLDC) design, sometimes called a stepper motor. Rather than using brushes to commutate the DC polarity to the electromagnet drive elements 51, electronic circuitry in controller 70 is used instead to manage the polarity of the drive elements 51. This has specific advantages when the motor drive shaft is connected directly to the feed cone 45. The present invention uses interactions between driven elements 61 (preferably permanent magnets) and electromagnetic drive elements 51 in the motor to create a fully electronic clutching mechanism that can be easily adjusted electronically, directly connected to the feed cone, and eliminate mechanical clutching by replacing it with an induction drive.

Drive platform 50 comprises a plurality of electromagnetic drive members 51 each fixedly connected to platform 50 and symmetrically arranged in a common plane about rotational axis 100. The symmetrical arrangement is circular with the circle 53 having a diameter "D" as shown in FIG. 4. Each drive member 51 may be selectively and individually energized thereby causing the polarity of each element to cycle between positive and negative, controlled by controller 70, such that a pattern of polarity shifts in the drive members 51 migrates around the circular pattern of the members arranged on the platform 50. Shaft 49 extends generally perpendicularly from drive platform 50 to provide an axle for rotational connection of feed cone 45. A plurality of ferritic driven members 61 are radially positioned on a bottom plane of the paintball loader feeder cone 45 and arranged in a generally circular pattern having a diameter generally matching the diameter of the circular pattern of the drive members 51 so that the driven members 61 and drive members 51 are disposed generally adjacent and in parallel planes. As individual drive members 51 are energized to produce a magnetic flux, the driven elements 61 are subjected to the magnetic force which, in turn, causes the feeder cone 45 to rotate. At least one drive member 51 remains energized during operation to prevent the feeder cone 45 from freely rotating, thus eliminating the need for a ratchet or similar rotation limiting mechanism to prevent reverse rotation of the feeder cone. The absence of a positively-engaging anti-reversing ratchet enables the feeder cone 45 to be manually rotated in either direction using a typically supplied external thumbwheel simply by overcoming the magnetic force of the coupling.

The number of driven members 61 and electro-magnetic drive members 51 determine the angular advancement of the drive cone for each energized/de-energized cycle of the drive members and hence may influence both the rate of feed cone rotation and the torque transfer into the feed cone. The number of drive 51 and driven members 61 may be equal, but are not required to be so. Testing with five drive members and five driven members 61 has demonstrated a suitable level of drive cone advancement. Numbers as few as two and as large as is practicable to fit into the available space beneath a loader feeder cone are considered within the scope of the invention.

The torque transfer capability of the drive apparatus may be varied in a variety of ways. The diameter "D" of the circle 53 on which the drive and driven members 51, 61 are arranged may be varied within the physical limitations of the feed cone and loader. A larger diameter circle enables greater torque transfer for a given magnetic strength than does a smaller diameter circle. Electromagnetic strength of the drive members 51 may be varied through variations in the current flow, discussed in further detail below, which directly influences the torque transfer capability. Spacing between the planes of the drive and driven members may be altered to adjust the torque transfer. Adjustment of the vertical position of platform 50 as shown by the arrows in FIG. 3 using an adjuster mechanism 59 configured to vertically position the platform provides the most straightforward approach for adjusting the separation between the drive and driven members as a method for selecting the desired torque transfer. Adjuster mechanism 59 may be designed into an end product to allow the end user to adjust the torque transfer level and fine-tune the active loader for the specific conditions or paintballs being used. Alternatively, a torque-resistant friction fit between platform 50 and the loader would allow a user to slide the platform vertically to adjust the separation without the complexity of an adjustment mechanism. Another alternative for torque variation is to replace the ferretic elements with magnets. The polarity cycling of the electromagnets would then combine with the inherent polarity of the driven elements for either attractive or repulsive motion, or a combination of polarity shifting wherein multiple or all of the electro-magnets would be simultaneously energized and the polarity would be cycled between positive and negative to create the rotating stepper pattern.

Another noted advantage of the brushless induction drive is that the electromagnets, indeed the entire drive mechanism, need not be directly exposed to the interior of the paintball storage hopper. By providing a continuous bottom liner of the hopper with electromagnets positioned on the outside of the hopper, the electromagnets are not exposed to paint from a ruptured paintball. The feeder cone can be easily removed and the interior surface of the hopper wiped to remove the paint contamination without having to clean the electro-magnets or associated wiring. The electro-magnets may also be entirely encased in the non-metallic material from which the loader is formed to maintain their position, prevent contamination, and protect the wiring connections.

Figure 5:
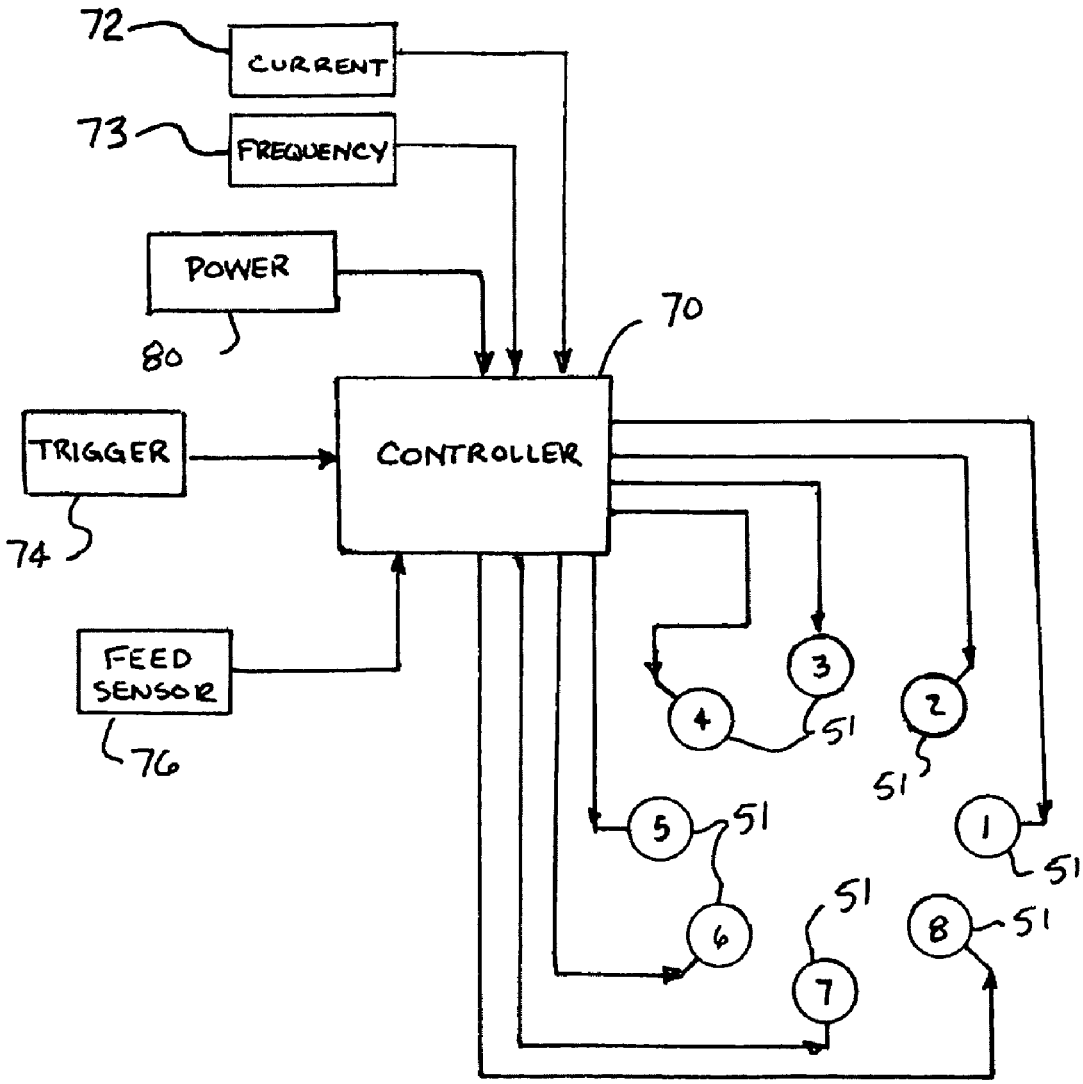
FIG. 5 is a simplified schematic diagram of the operation of the drive apparatus controller.

Referring to FIG. 5 in conjunction with FIGS. 3 and 4, controller 70 manages selective energization of the electromagnetic drive members 51 in order to control their polarity based on a triggering event, generally initiated in trigger mechanism 74. The triggering event may be provided from the marker itself, such as monitoring movement of paintballs into the firing chamber, or by monitoring movement of paintballs in the feed tube from the loader, whether directly or indirectly.

Brushless DC (BLDC) induction drives are pulse driven with the electrical pulses being managed by controller 70. As a result the rotational speed of a BLDC motor may be precisely controlled by the rate of pulses directed from the electronic controller 70 to the BLDC motor drive elements 51. This allows for exact regulation of motor revolutions per minute (RPM), and allows precise setting to competition specifications. A BLDC design also offers higher torque levels at low rotational speed, speed typical of the speed desired for feeder cone rotation. Increased torque capability of the BLDC design enables a direct coupling between the driver and the feeder cone eliminating the need for a gearbox, pulley system, or other drive ratio reduction system between the motor drive and the feed cone. Elimination of these sub systems eliminates related failure mechanisms and reduces the size and complexity of the feed cone drive system.

As noted above, one method of torque transfer control is through management of the current applied to the electromagnet drive elements 51. Controller 70 preferrably includes at least two inputs: current flow 72 and frequency 73. Thus the invention may independently regulate both torque transfer and rotational speed of the feeder cone. Current flow control input 72 regulates electrical current from the power supply 80 to the motor drive elements 51, thereby controlling torque application to the paintball from the feed cone 45. Frequency input 73 controls the oscillation speed of the polarity shifts in the drive elements 51, thereby directly controlling the rotational speed of the feed cone 45 and thus the feed rate of paintballs into the feed tube. Adjustment of the oscillator contained within the microcontroller 70 causes the rate at which pulses are generated to be increased or decreased. The electrical pulses are directed through to dual H-Bridges, which act as signal amplifiers and switch the regulated current signals to the drive element electromagnets 51. The microcontroller 70 can select the polarity output of the H-Bridge, and hence control the rotation of the feed cone 45.

Upon receipt of the triggering event, the controller 70 intermittently directs current pulses to the drive members 51 in a sequential pattern to cause rotation of the feeder cone, in effect creating a magnetic stepper drive wherein the stepping function is initiated by a triggering event. This is illustrated in FIG. 5 wherein the eight drive members would be sequentially energized as labeled in the figure. In a typical paintball marker/active-loader combination, triggering events can be actual trigger pulls, sensing of paintballs loading into the firing chamber, movement of paintballs in the loader feed tube, or any other of the known methods for triggering active paintball loaders. A feed sensor 76 may be incorporated to monitor paintball movement from the loader so that the controller 70 is not solely reliant on the trigger to signal the demand for a paintball.

In one embodiment, the controller 70 is a commercially available light flasher circuit of the kind commonly used to cause an array of lights to sequentially illuminate to form a flashing pattern. Such controllers are readily adjustable for pulse frequency and duration. Adjustment of pulse frequency and duration allows the loader drive to be fine-tuned for the specific operating conditions of the loader and the paintballs. For example, upon sensing that a paintball is to be fed into the marker, the drive controller can initiate sequential pulsing of the electro-magnetic driver elements 51 and continue the sequential pulsing until the sensor determines that a paintball has been fed. During this time, it may be desirable to have the feeder cone rotate further than just the amount to advance a single paintball into the marker firing chamber. Additional rotational motion may be required to engage and then advance a paintball if the supply of paintballs in the hopper is low. Adjusting the frequency and pulse duration of the electromagnet drive element controller provides yet another method for effectively varying the effective force (torque transferred) urging the paintballs in the loader toward the marker firing chamber.

The unique characteristics of a BLDC motor allow torque generated by the drive elements 51 to be precisely managed and limited, effectively limiting the force exerted on the paintballs by the feed cone 45. By properly selecting the value of this torque limit, the present invention may be configured to rotate the feed cone and deliver paintballs at a maximum rate when paintballs are being fired by the marker, but cease rotation by stalling (torque limited) when paintball consumption slows, or ceases (for example the paintball gun not being fired). Such an arrangement eliminates the need for a triggering event from the marker and allows the drive mechanism to be initiated with the controller continuously cycling the polarity of the drive elements. The result is an inductive clutching effect for the feed cone 45 interaction with the paintballs.

The controller and the electro-magnetic drive elements are powered by an on-board power supply 80, typically a 9-volt battery, which is already common in the paintball marker/active loader designs available in the market. Other power supply means for the control circuit are contemplated within the scope of the invention.

Although the invention has been described in connection with specific examples and embodiments, those skilled in the art will recognize that the present invention is capable of other variations and modifications within the scope of the invention but beyond those described herein. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention as presented in the following claims.

We claim:

1. An active paintball loader for use with a paintball marker, said loader operably connected to said marker and comprising:

a hopper for containing paintballs;

a feed tube for conveying paintballs from said hopper to the marker;

a feed cone disposed within said hopper rotatable about an axis fixed in relation to said hopper, said feed cone configured for urging by rotation thereof paintballs from said hopper into said feed tube; and a drive mechanism for rotating said feed cone about said axis irrespective of orientation of said axis, said drive mechanism further comprising:

a plurality of magnetic driven elements connected to said feed cone, said plurality of driven elements arranged in a first plane generally symmetrically about a rotational axis fixed in relation to said loader;

a plurality of electromagnetic drive elements connected to said loader, said plurality of drive elements arranged in a second plane generally symmetrically about said rotational axis and fixed to the loader in a manner to preclude movement about said rotational axis, said second plane being spaced apart from and generally parallel to said first plane, each of said plurality of drive elements being selectively alterable between a first polarity state and a second polarity state, said second polarity state having a polarity opposite of said first polarity state; and a controller for managing said polarity states of each of said plurality of said drive elements, said controller configured to sequentially change said polarity state of each of said plurality of drive elements between said first and second polarity states in a manner to cause rotation of the feed cone thereby urging paintballs from the hopper into the feed tube.

2. The paintball loader of claim 1, wherein said controller manages said polarity states of each of said plurality of drive elements by variation in an electrical current directed through each said drive element.

3. The paintball loader of claim 2, wherein said controller manages a rate of change between said first and said second polarity states of each of said plurality of drive elements by variation in an electrical current directed through each said drive element.

4. The paintball loader of claim 3, further comprising a frequency adjustment mechanism for selectively determining said rate of change between said first and said second polarity states for each drive element to thereby establish a speed at which the feed cone will be rotated.

5. The paintball loader of claim 4, further comprising a current adjustment mechanism for selectively determining said electrical current directed through each drive element to thereby establish a torque that will be applied to the feed cone.

6. The paintball loader of claim 1, wherein said plurality of magnetic driven elements are permanent magnets.

7. The paintball loader of claim 1, further comprising a platform connected to the loader and disposed adjacent to and spaced apart from said first plane, wherein said platform is movable in a direction parallel to said rotational axis and selectively positionable between generally opposing first and second positions thereby enabling said torque applied to the feed cone to be varied.

8. The paintball loader of claim 7, wherein variation in the number of individual drive elements in said plurality of drive elements enables said torque input level to be varied.

9. An active paintball loader for use with a paintball marker comprising:

a hopper for containing paintballs;

a feed tube for conveying paintballs to the marker;

a rotatable feed cone for urging paintballs from the hopper to the feed tube;

a plurality of magnetic driven elements connected to said feed cone, said plurality of driven elements arranged in a first plane generally symmetrically about a rotational axis fixed in relation to said loader;

a platform connected to the loader and disposed adjacent to and spaced apart from said first plane;

a plurality of electromagnetic drive elements connected to said platform, said plurality of drive elements arranged in a second plane generally symmetrically about said rotational axis, said second plane being spaced apart from and generally parallel to said first plane, each of said plurality of drive elements being selectively alterable between a first polarity state and a second polarity state, said second polarity state having a polarity opposite of said first polarity state;

a controller for managing said polarity states of each of said plurality of said drive elements, said controller configured to sequentially change said polarity state of each of said plurality of drive elements between said first and second polarity states in a manner to cause rotation of the feed cone; and an input mechanism for initiating action of said controller thereby causing paintballs to be urged from the hopper to the feed tube.

10. The paintball loader of claim 9, wherein said symmetrical arrangement of said plurality of driven elements is circular, having a first diameter centered about said rotational axis, said symmetrical arrangement of said plurality of drive elements is circular, having a second diameter centered about said rotational axis, and said first and second diameters are generally equal.

11. The paintball loader of claim 10, wherein said platform is movable in a direction parallel to said rotational axis and selectively positionable between generally opposing first and second positions.

12. The paintball loader of claim 11, wherein said controller further comprises a current adjustment mechanism for selecting a rate of current flow through each of said plurality of drive elements and a frequency adjustment mechanism for selecting a rate at which said plurality of drive elements change between said energized and said de-energized states to thereby selectively establish a speed at which the feed cone will be rotated and/or a torque input level from said drive mechanism to the feed cone.

13. The paintball loader of claim 12, wherein variation of said first and second diameters enables said torque input level to be varied.

14. The paintball loader of claim 12, wherein variation in the number of individual drive elements in said plurality of drive elements enables said torque input level to be varied.

* * * * *